US005987894A

United States Patent [19]

Claudet

[11] Patent Number: 5,987,894

[45] Date of Patent: Nov. 23, 1999

[54] TEMPERATURE LOWERING APPARATUS USING CRYOGENIC EXPANSION WITH THE AID OF SPIRALS

[75] Inventor: Gérard Claudet, La Tronche, France

[73] Assignee: Commissariat A L'Energie Atomique, Paris, France

[21] Appl. No.: 09/007,728

[22] Filed: Jan. 15, 1998

Related U.S. Application Data

[63] Continuation-in-part of application No. PCT/FR96/01102, Jul. 16, 1996.

[51] Int. Cl.[6] ..... F25B 9/00

[52] U.S. Cl. ..... 62/6; 62/499; 62/904; 60/520

[58] Field of Search ..... 62/6, 499, 904; 60/520

[56] References Cited

U.S. PATENT DOCUMENTS

| | | | |
|---|---|---|---|
| 2,281,065 | 4/1942 | Lavigne | 62/904 |
| 2,586,207 | 2/1952 | Collins | 62/904 |
| 3,498,370 | 3/1970 | Baees | 62/904 |
| 3,817,664 | 6/1974 | Bennett et al. . | |
| 4,291,547 | 9/1981 | Leo . | |
| 4,472,120 | 9/1984 | McCullough . | |
| 5,391,065 | 2/1995 | Wolverton et al. . | |

FOREIGN PATENT DOCUMENTS

| | | |
|---|---|---|
| 0 122 722 | 10/1984 | European Pat. Off. . |
| 0 275 415 | 7/1988 | European Pat. Off. . |
| 1596943 | 6/1970 | France . |
| 2532011 | 2/1984 | France . |
| 30 17 045 | 11/1980 | Germany . |
| 59-110894 | 6/1984 | Japan . |
| 2132276 | 7/1984 | United Kingdom . |

*Primary Examiner*—Ronald Capossela
*Attorney, Agent, or Firm*—Eugene Lieberstein; Michael N. Meller

[57] ABSTRACT

The apparatus for the expansion of fluid in the gaseous or liquid state or in double phase is characterized in that it has an expansion compartment comprising:

a first spiral (72), a second spiral (70) located within said first spiral, means (52, 63) to permit a circular translation movement without self-rotation of the second spiral within the first spiral during the expansion of a fluid.

30 Claims, 9 Drawing Sheets

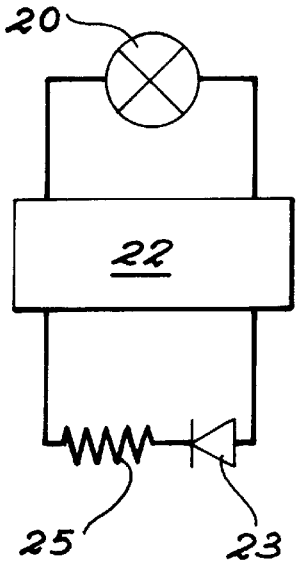
FIG. 2A
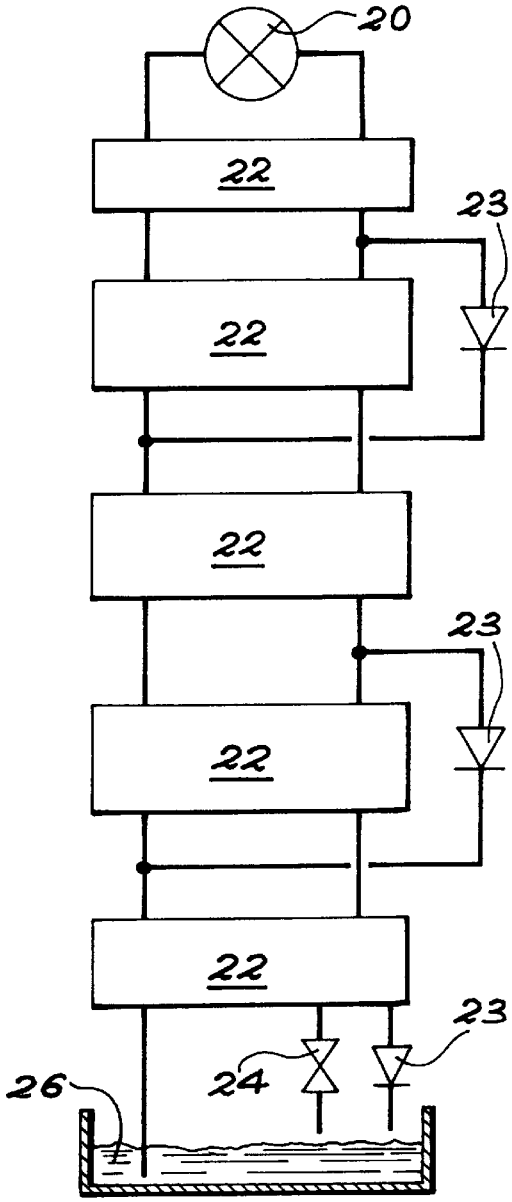
FIG. 2B
FIG. 4A
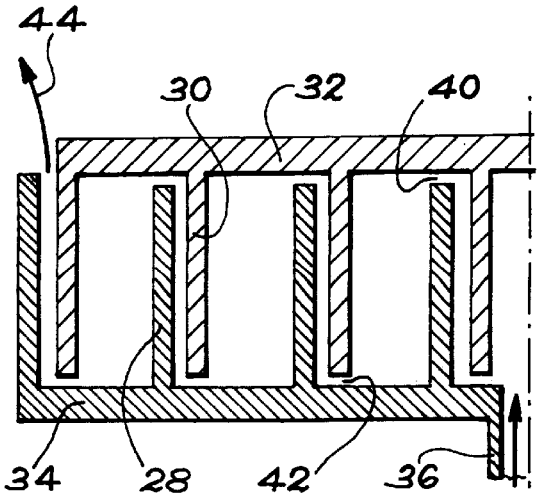

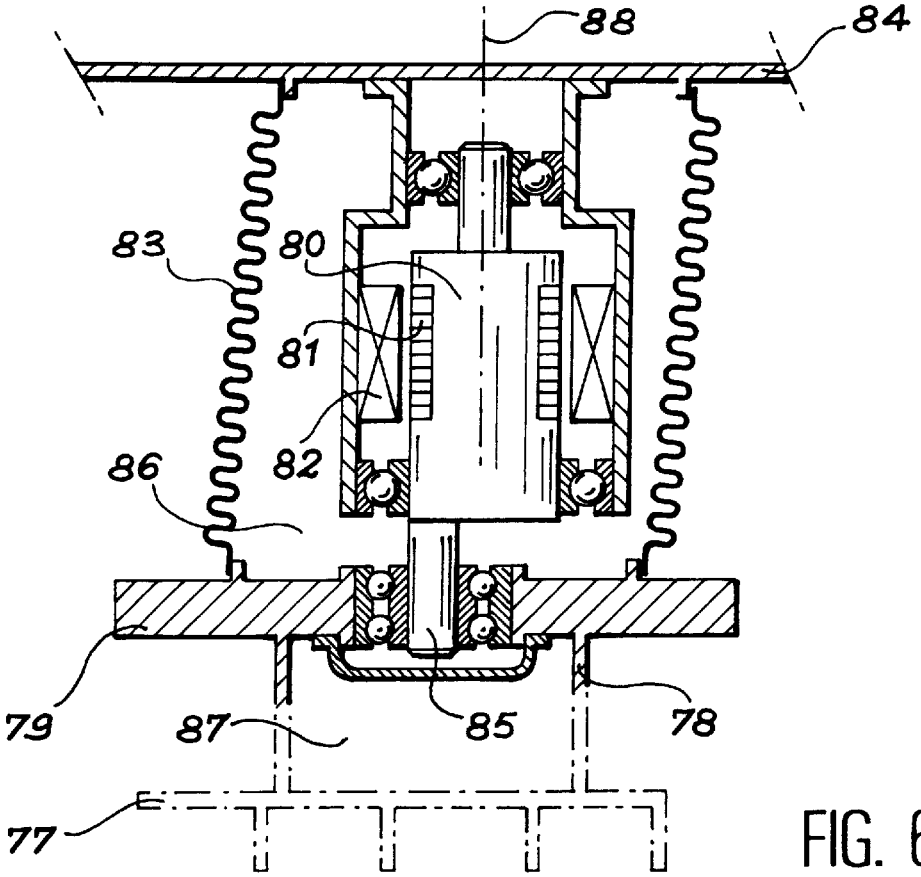
FIG. 6
FIG. 7
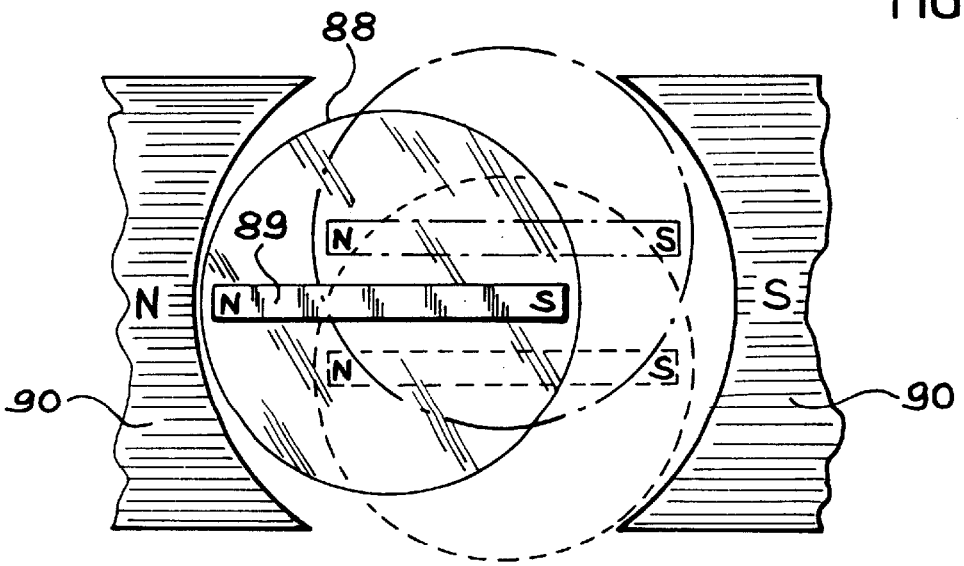

TEMPERATURE LOWERING APPARATUS USING CRYOGENIC EXPANSION WITH THE AID OF SPIRALS

This is a continuation in part application of International Application PCT/FR96/01102 filed on Jul. 16, 1996.

TECHNICAL FIELD AND PRIOR ART

The invention relates to the field of cryogenic expansion engines.

Cryogenic refrigeration gas cycles can be placed in two categories as a function of the process used, either a reciprocating, periodic circulation, or a permanent circulation in a defined direction of the gas.

In alternate circulation cycles, the gas exchanges heat with a heat accumulator or a heat regenerator, which retains the heat when the gas circulates in one direction and restores it during the return in the reverse direction.

The best known alternate circulation cycles are the Stirling, Gifford and MacMahon cycles, or also the pulsation tube cycle. The latter is generally reserved for the production of low refrigerating capacities of a fraction of a watt to 4 kelvin, about 10 watts to 15 kelvin and about 100 watts to 80 kelvin.

A diagrammatic description of the corresponding apparatuses is given relative to FIGS. 1A to 1C.

FIG. 1A shows a Stirling engine. A pressure oscillator or compressor 1 is constituted by a piston mechanically actuated by a crankshaft.

The Gifford and MacMahon engine illustrated in FIG. 1B is characterized by a gas compressor 3 with a low pressure inlet 4 and a high pressure outlet 5 of a permanent nature and connected to the actual refrigerating machine 10 by an inlet valve 6 and an outlet valve 7 respectively, which are opened in turn in order to produce the necessary pressure cycles.

The refrigerating machine 10 connected to these compressors 1 and 3 is the same in both cases. It is constituted by a tube 9 in which slides a displacement piston 11, which subdivides the content of the tube 9 into two variable volume chambers, interconnected by a bypass 12, on which is installed a heat regenerator 13. The chamber connected to the compressor 1 or 3 is at temperature T2 (corresponding to the hot source) and the other chamber is at the temperature T3 of the cold source. The displacement piston 11 passes compressed gas from the chamber at temperature T2 to the chamber at temperature T3, exchanging its heat with the heat regenerator 13 in response to pressure rises in the compressor. The expansion of the gas is produced when it mainly occupies the chamber at temperature T3, then the gas is reheated on traversing the heat regenerator 13 to the chamber at temperature T2 before undergoing a new cycle. Thus, the heat regenerator 13 has the property of restoring to the gas circulating therein in one direction the heat which it has previously taken from the gas circulating in the reverse direction. In the case of FIG. 1B, the chamber at temperature T2 communicates with the compressor 3 by the inlet 4 and the outlet 5. In the case of FIG. 1A, the connection of the compressor 1 to the chamber of the compressor at temperature T2 is brought about by a single pressure inlet pipe 15.

On the basis of the illustration of FIG. 1A, it can be seen that such alternating engines are the seat of two periodic waves in the expansion volume 15, the one of pressure and the other of flow. It is possible to control the phase shift of these two waves by mechanical means, which control the movements of the compressor 1 or valves 6 and 7, generally at ambient temperature, and of the displacement piston 11 which, for cryogenic applications, must be able to operate at very low temperatures. Thus, one effectively arrives at the sought situation where the maximum expansion, i.e. the maximum heat absorption, is simultaneous with the maximum gas flow in the cold source T3.

FIG. 1C illustrates a pulsation tube engine or machine. It comprises a pressure oscillator 16, symbolized by a mechanical compressor, a heat regenerating 17 connected to the compressor 16 by a pressure inlet pipe 18 and a pulsation tube 19, which is connected to the end of the heat regenerator 17 opposite to the pressure oscillator 16. The pulsation tube 19 is closed at the end opposite to the heat regenerator 17. By the combined effect of the different volumes and constrictions, the phase shift necessary for the refrigerating effect of the flow and pressure waves is obtained by totally static means in the pulsation tube 19, which is therefore free or deprived of any mobile object such as a displacement piston. Thus, more specifically, the pulsation tube 19 is constricted close to the heat regenerator 17 where the cold source SF is located, whereas the hot source SC is located at the opposite end of the pulsation tube 19, at the end of a widened portion and e.g. cylindrical portion thereof. The gas column is subject to maintained oscillations and the dimensions and shape of the different elements of the apparatus make it possible to choose the operating frequency so as to obtain the phase shift of the flow and pressure waves effectively making it possible to extract heat from the cold source in order to transfer it to the hot source.

Continuous circulation cycles are better adapted to the production of high power levels. Such engines, operating on the principle of the Brayton cycle and the Claude cycle are respectively illustrated in FIGS. 2A and 2B. They are constituted by different arrangements of the three following main components:

- a compressor 20 recycles the gas of the low pressure (LP) level, normally close to atmospheric pressure, to the high pressure level, generally between approximately 15 and 30 bars,
- one or more countercurrent heat exchangers 22 ensure the pre-cooling of the compressed gas by exchange with the gas at low pressure,
- one or more expansion machines 23 are the true source or sources of refrigerating output, use being made either of machines 23 in which the gas supplies a mechanical energy or work, or simple constrictions or expansion valves 24, where the gas undergoes a pressure drop.

The Brayton cycle (FIG. 2A) can operate with nitrogen if the desired cold source 25 is at a temperature above 80 kelvin. For lower temperatures, the cycle gas will generally be helium.

The Claude cycle of FIG. 2A corresponds to a helium cycle, whose cold source 26 is a liquid helium bath.

The expansion machines able to produce energy or work applying the first principle of thermodynamics according to which the sum of the heat quantities Q and the work W used in a reversible transformation cycle is zero:

$$W+Q=0.$$

Thus, an expansion with work will still make it possible to absorb heat, but it requires the use of machines or engines, whose cold parts are moving.

A work-free expansion or at constant enthalpy does not absorb heat, but it is generally used in the immediate vicinity of the saturation curve of the fluid in order to bring about the phase change by expansion of the gas, which is partly liquefied.

Expansion with work is effected either in turbines when the flow is adequate, or in piston machines somewhat better adapted to low flow rates.

In both cases, the gas being expanded must not in practice be able to exchange heat with the cold source and the expansion obtained is said to be adiabatic or isentropic.

For certain applications, it could be preferable to obtain the conditions of an isothermal expansion making it possible to extract more heat, provided that a permanent heat exchange is ensured with a small temperature variation between the cold source and the gas being expanded.

Both for turbines and piston engines, the expansion with phase change must be proscribed in order to prevent mechanical destruction, either of the turbine unbalanced by droplets, or of the piston subject to "slugging" of the liquid which may accumulate therein.

Even on limiting their use outside the presence of liquid as a result of temperatures or pressures of a sufficiently high level, the currently used expansion engines give rise to numerous design or use difficulties.

Expansion turbines must rotate at high speeds of several dozen or several hundred thousand revolutions per minute and are generally supported by contactless and normally gas bearings. In order to treat low flow rates, turbines are not very suitable for miniaturization.

Thus, when the diameter drops towards centrimetric sizes, the clearance between the mobile and fixed parts of the turbine assumes a relatively increasing importance and the leak flow, expanded without work, makes efficiency drop. When the injection nozzles where the gas circulates at sonic speed have to be reduced to diameters of a tenth of a millimeter, the flow conditions rapidly become disturbed and constitute the source of irreversibilities, or are simply exposed to impurities.

A priori, piston expansion machines or engines are better adapted than turbines to treat small flow rates, but their reliability is greatly conditioned by the implementation of the rubbing seal between piston and cylinder and by the existence of cold valves with the associated control mechanisms.

U.S. Pat. No. 3,817,664 describes a pump having two parallel-operating pumping units, one pumping in spiral towards the outside and the other towards the inside.

DESCRIPTION OF THE INVENTION

The invention relates to an original solution making it possible to produce engines for the cooling of fluid by expansion and in particular of a cryogenic nature (either isentropic or, if necessary, isothermal), which are better adapted than piston engines and turbines for the treatment of low flow rates with a high efficiency and reliability, whilst being insensitive to the presence of liquid or fluid in double phase.

The invention relates to an apparatus for lowering the temperature of a fluid by expansion of the fluid, in the gaseous or liquid state or in double phase, characterized in that it has an expansion compartment comprising:

- a first spiral,
- a second spiral located within said first spiral,
- means for permitting a circular translation movement without self-rotation of the second spiral within the first spiral, during the expansion of a fluid.

This apparatus makes it possible to reduce the temperature of the fluid due to the expansion performed in the expansion compartment. Thus, the fluid is cooled as soon as it leaves said compartment.

The invention uses contactless moving parts and makes no use of valves. This apparatus is compatible with a miniaturization for the treatment of low flow rates. It is also possible to accept without causing any problem the formation of a two-phase fluid during expansion. It can also incorporate in one of the spirals at least one heat exchange circuit permitting a move towards isothermal conditions.

The means permitting the circular translation movement without self-rotation can be in various forms and can e.g. comprise:

- two offset or eccentric shafts, each being connected to the mobile spiral by an end rotating about a spindle fixed with respect to the apparatus,
- or at least one deformable part connected by one of its ends to a fixed portion of the apparatus and whose other end is connected to the mobile spiral,
- or magnetic means exerting on the mobile spiral or on a fixed portion with respect to the mobile spiral, forces such that the translation can take place whilst preventing any rotation.

In addition, means can be provided for controlling the rotation speed of the mobile spiral during its movement.

Thus, in the case of a movement with two cams, one of them can carry the rotor of an electric brake, the stator being fixed relative to the apparatus.

In the case of a movement with deformable parts, the mobile spiral can be connected to a part around which a second eccentric rotates, a part connected to the eccentric bush being able to support the rotor of an electric brake. The rotation of said bush can take place with, on at least one of its two faces, a contactless bearing of the magnetic or gas type.

A means for controlling the axial clearance between the two spirals can be provided. The spirals can e.g. be Archimedean spirals or defined by a succession of circular arcs.

A fluid expansion system can comprise at least two expansion stages, each comprising an apparatus according to one of the forms described hereinbefore. A common shaft can optionally permit a movement in phase of the mobile spirals of the different expansion apparatuses.

Thus, a cryogenic expansion engine can comprise a compressor, an exchanger and an expansion system or apparatus as described hereinbefore.

BRIEF DESCRIPTION OF THE DRAWINGS

The invention is described in greater detail hereinafter relative to non-limitative embodiments and with reference to the attached drawings, wherein show:

Figure 1A:
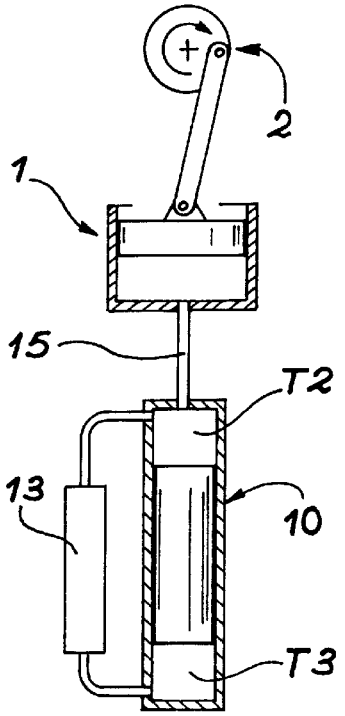
Figure 1B:
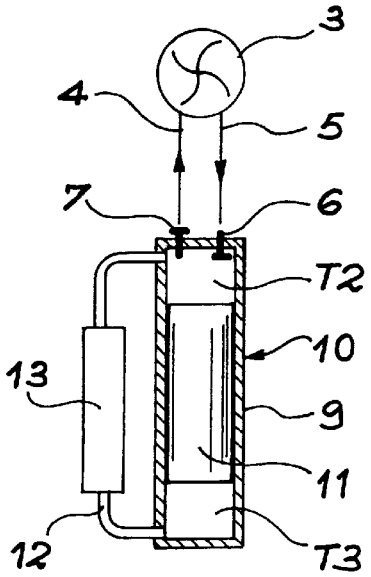
Figure 1C:
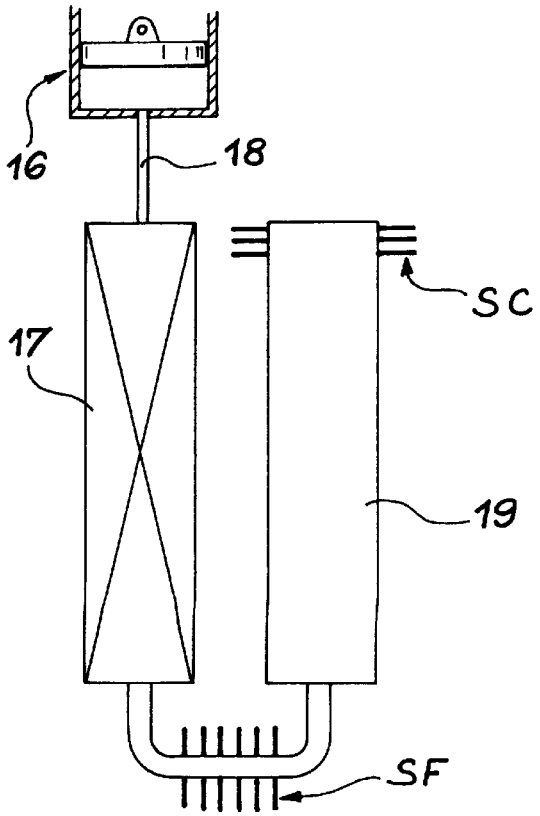
Figure 3:
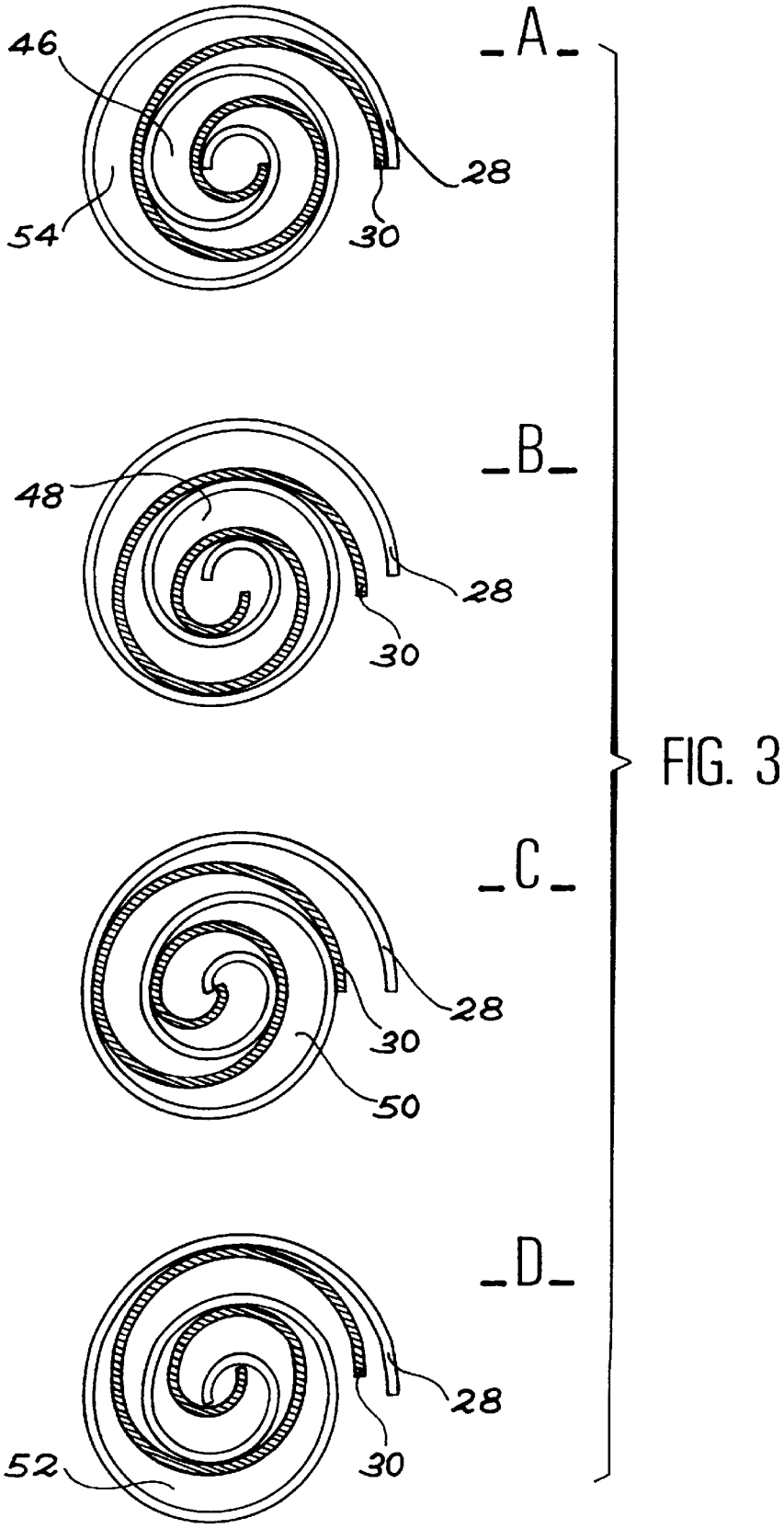
Figure 4B:
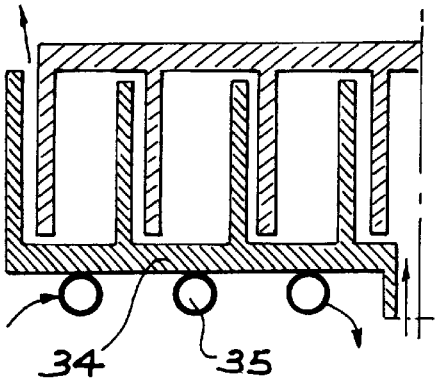
Figure 4C:
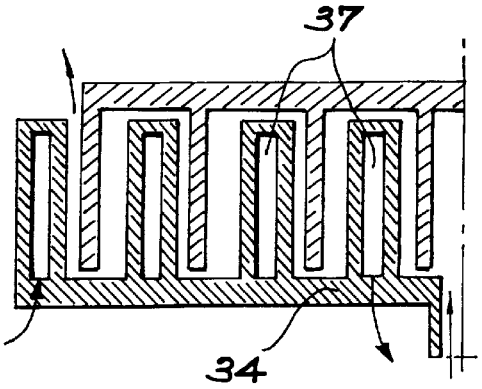
Figure 3E:
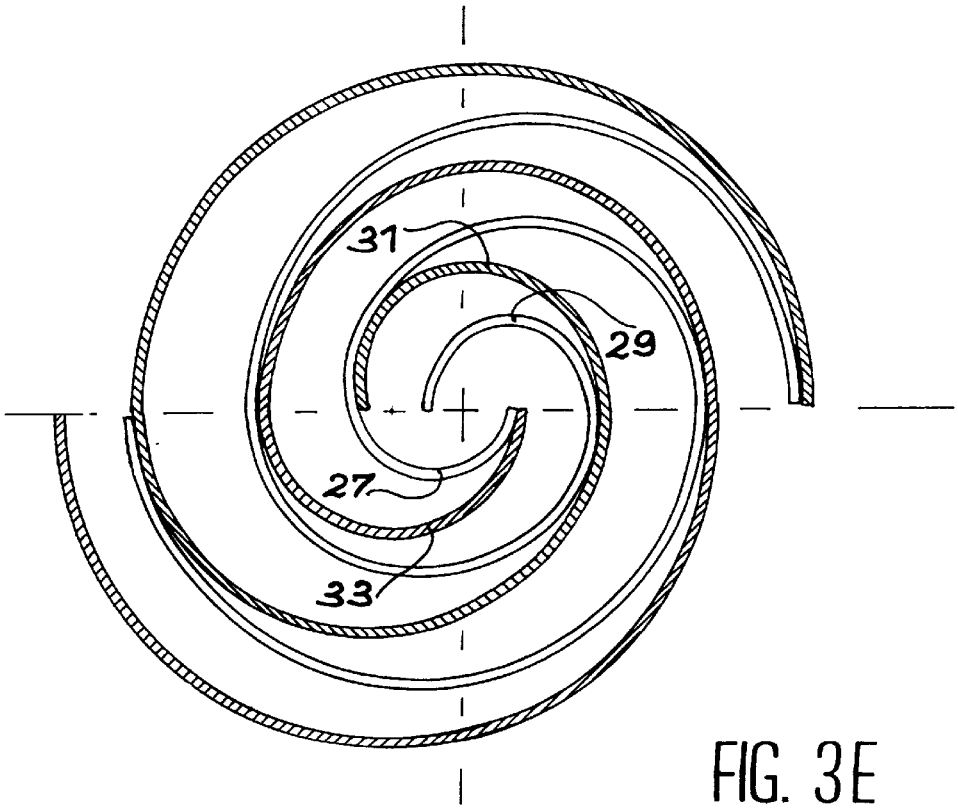
Figure 5:
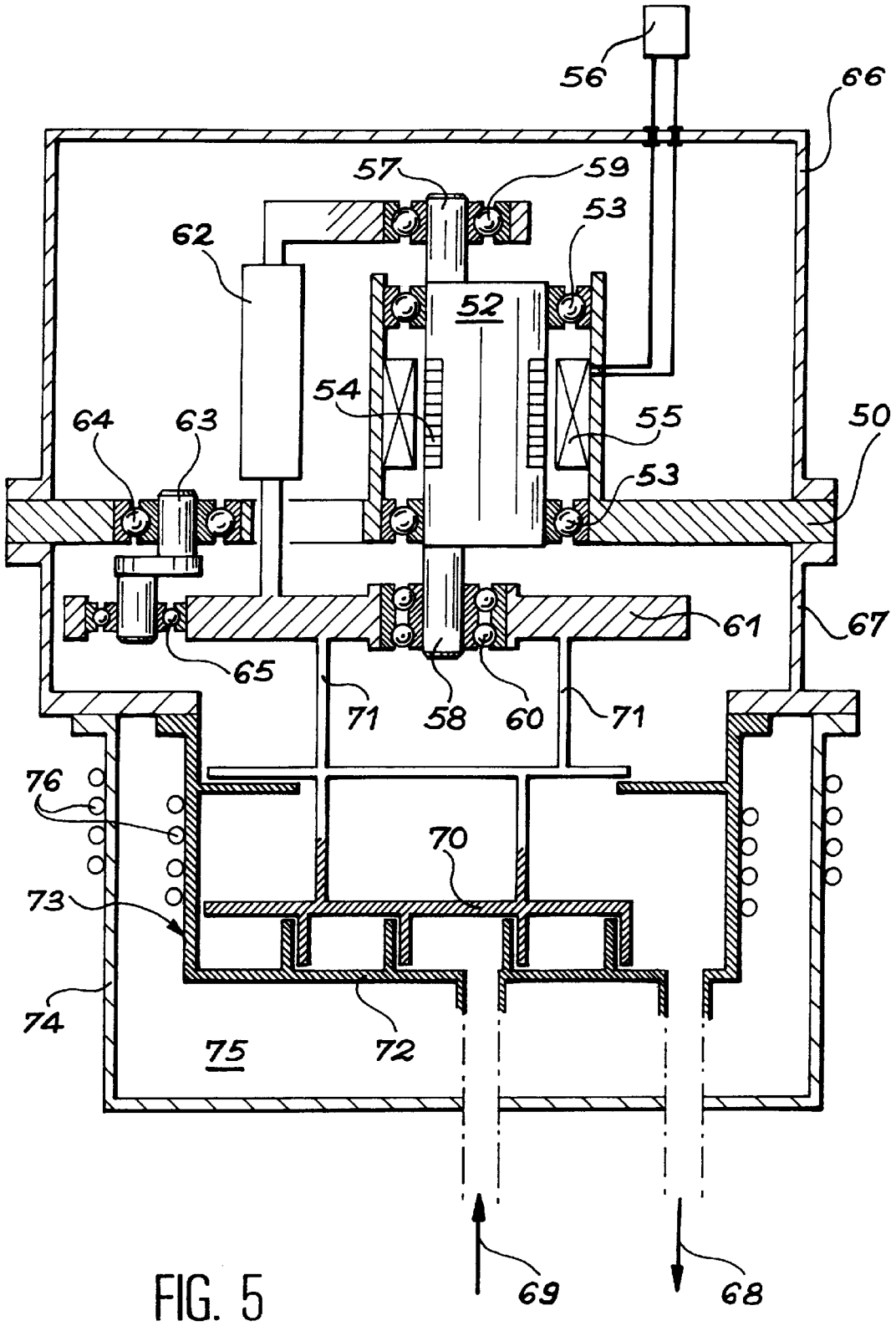
Figure 8:
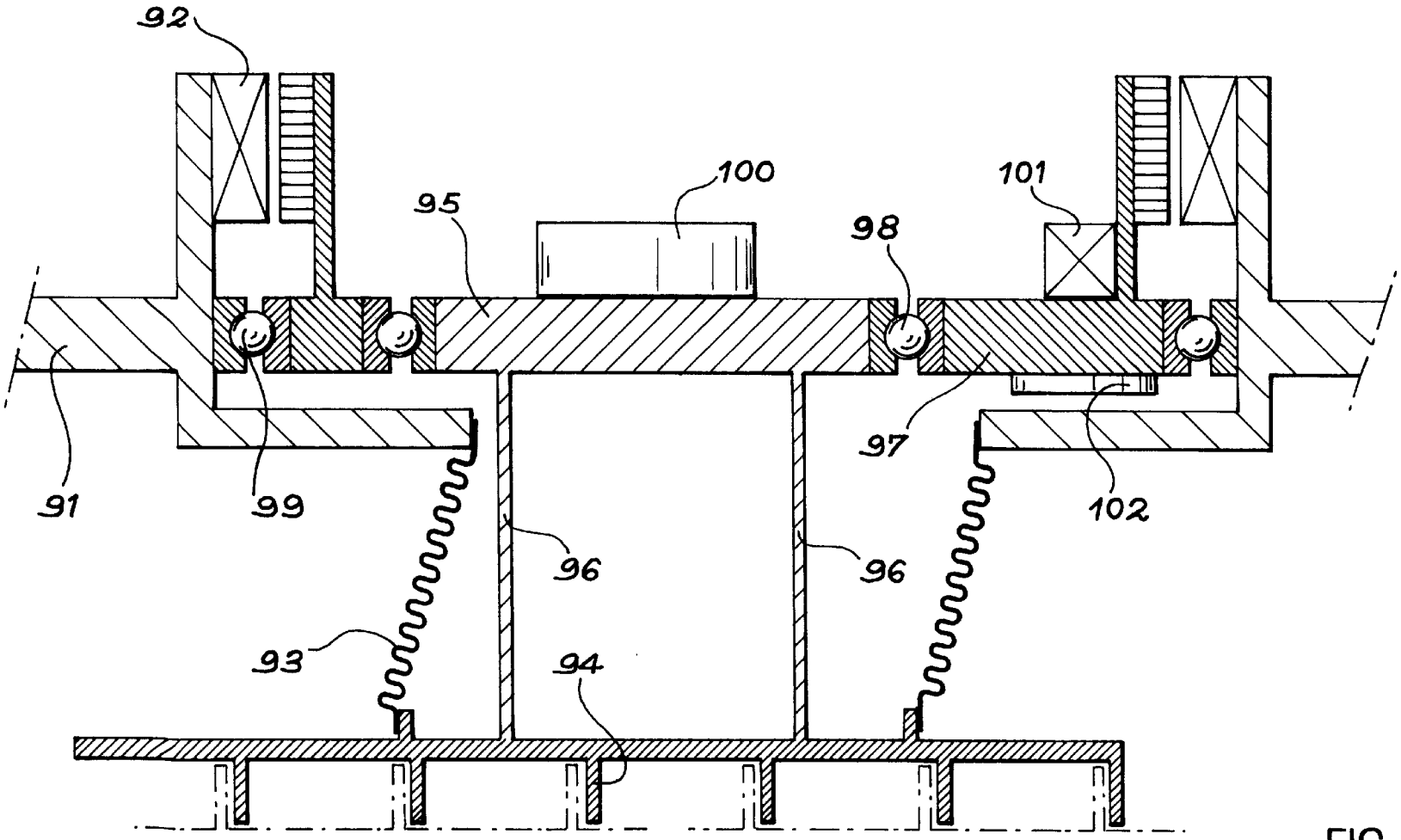
Figure 9:
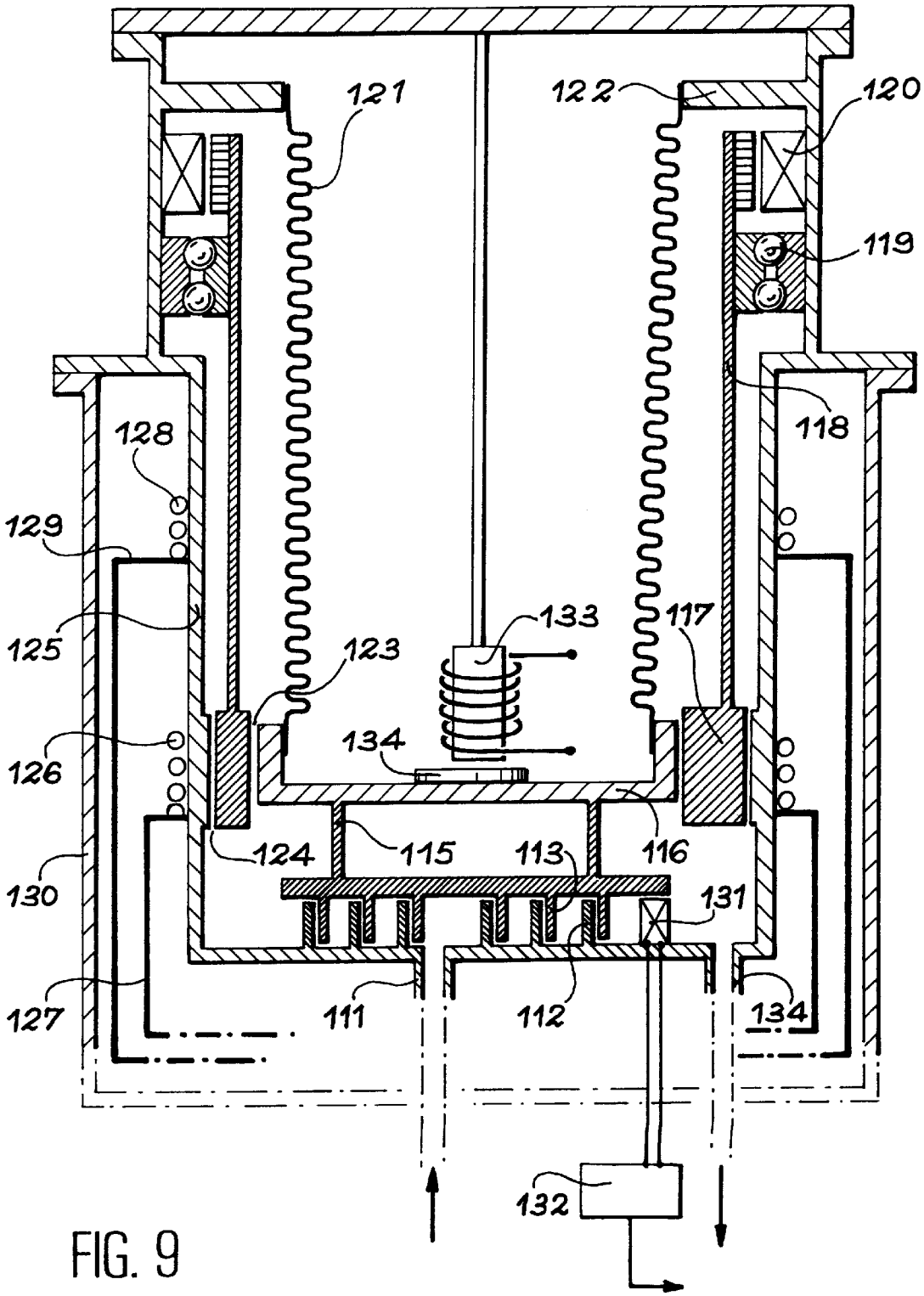
Figure 10:
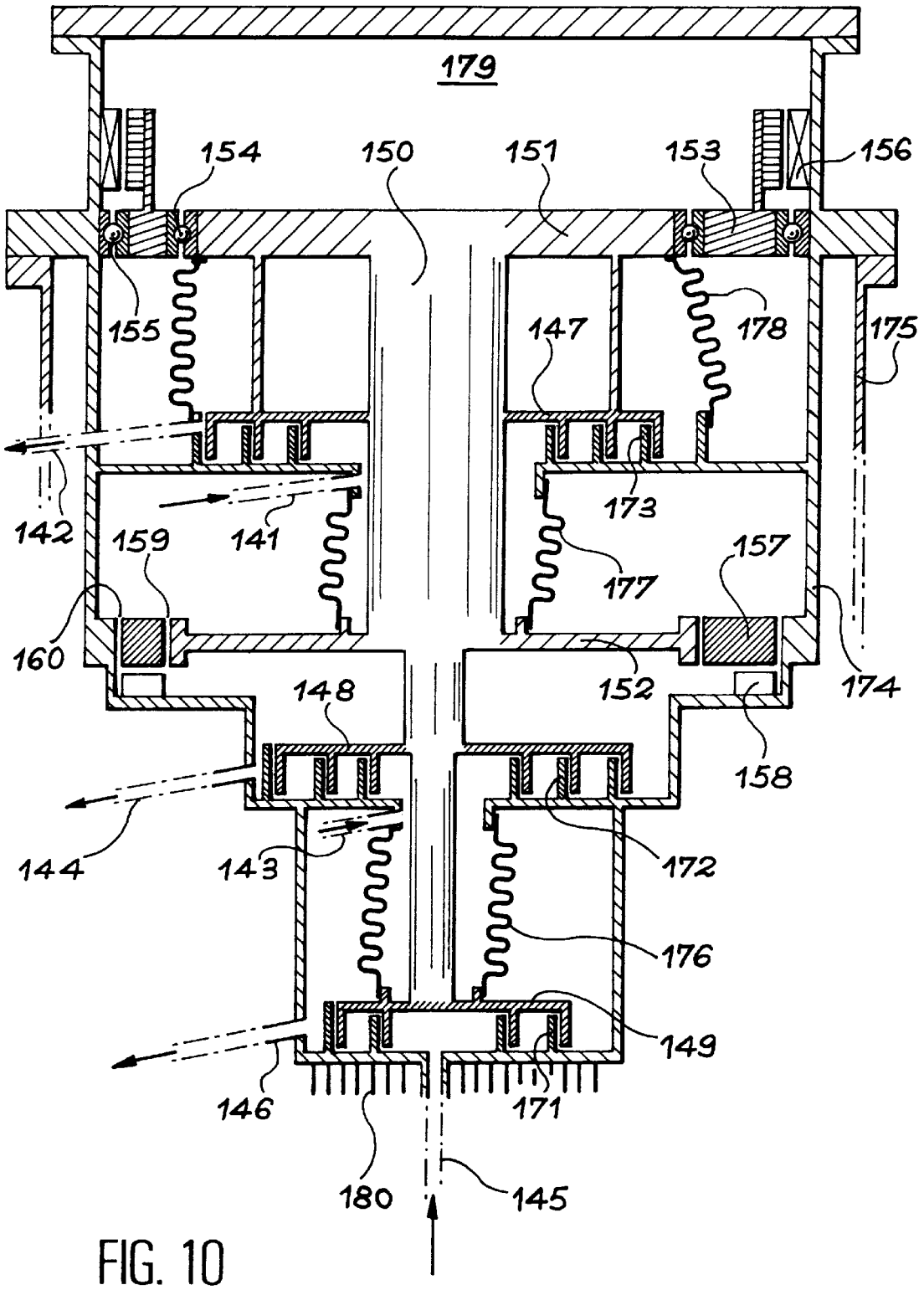

| | |
|---|---|
| FIGS. 1A to 1C | Respectively Stirling, Gifford and pulsation tube engines. |
| FIGS. 2A & 2B | Brayton and Claude engines. |
| FIGS. 3A to 3D | The operating principle of an expansion compartment of an apparatus according to the invention. |
| FIG. 3E | An embodiment with four spirals. |
| FIGS. 4A to 4C | A sectional view of an expansion compartment of an either adiabatic or isothermal apparatus according to the invention. |
| FIG. 5 | A first embodiment of the invention. |
| FIGS. 6 to 9 | Other embodiments of the invention. |
| FIG. 10 | An expansion engine with three stages according to the invention. |

DETAILED DESCRIPTION OF EMBODIMENTS

The principle of the invention is based on the use of an expansion compartment comprising, as illustrated in FIGS.

3A to 3D and 4A, a first fixed spiral 28 and a second spiral 30 arranged in mobile manner within the first. Each spiral rests on or is connected to a flat bottom 32, 34.

The gas to be expanded is introduced by an admission tube 36. An exhaust or escape can be provided. Thus, reduced clearances 40, 42 ensured between the upper part of the partitions 28, 30 of the spirals and the flat bottoms 32, 34 enable the fluid to escape to the exterior of the mobile spiral and then the fixed spiral (arrow 44 in FIG. 4).

The gas can only circulate or flow by increasing volume (expansion) and by exerting a force on the mobile wall 30 (work), exposed to a circular translation movement. As a result of this movement, each point of the spiral 30 describes a circle, the mobile part remaining permanently parallel to itself.

FIGS. 3A to 3D illustrate the performance of the expansion of the gas in different stages, by which it is possible to follow the evolution of a fraction of the gas, quarter turn by quarter turn. This gas passes through continuously increasing volumes 46, 48, 50, 52 and finally 54 prior to escape.

The volume of the gas being expanded is at all times limited by a partition of the fixed spiral and a partition of the mobile spiral, which become tangential every 180°, following their evolute.

These points of tangency bring about a partial or total seal as a function of whether the parts are in contact or preferably separated by a reduced clearance 40, 42.

The circular translation movement makes the points of tangency slide along the profile of the fixed spiral, thus enabling the gas to move from the centre towards the outside of the spiral, whilst increasing volume.

A very wide range is offered by the construction of the spiral parts in question:

- the spiral profiles could be Archimedean spirals (the radius R of such a spiral varying linearly with the angle as from the same centre ($R=a\theta$)),
- the profiles could be defined by a succession of circular arcs, of different centres and different radii, either e.g. for each half-turn, or each quarter-turn.

According to the flow rates to be treated and the expansion rates to be obtained, it would be possible to optimize the geometry, either by using a single spiral, or several nested spirals in a random number.

An embodiment with several spirals is illustrated in FIG. 3E. Two fixed spirals 27 and 29 are arranged in symmetrical manner at 180° with respect to an axis of symmetry Δ. Two mobile spirals 31 and 33 become alternately tangential on one face with the spiral 27 and on the other face with the spiral 29.

The thicknesses of the partitions of the spirals could be chosen constant or variable in order to optimize their mechanical strength and their space requirements.

The materials usable preferably satisfy the condition that the two parts (fixed and mobile) are compatible from the standpoint of their expansion, so that the reduced clearances are obtained under nominal, low temperature operating conditions. In order to reduce deformations, preference will be given to materials having low expansion characteristics, such as composites, e.g. of carbon fibres or metal alloys (such as Invar). In order to tend towards isothermal conditions, copper or aluminium would be more favourable. It is possible to use for the mobile part low density materials, such as titanium or light alloys, which are sufficiently strong to limit the inertia forces and deformations associated therewith.

Plastics materials can also be used. They must be in solid form. They can also be locally linked (in the form of segments or surface deposits), either in order to limit possible rubbing or friction effects, or for obtaining, by progressive wear, a grinding effect making the parts adapt their shapes to one another. Preferably there will be a better compromise between a limited contact and a small leak.

The essential advantages of the invention are the possibility offered for bringing about an expansion with work or energy of the gas, using contactless moving parts and without using valves.

The flow rate of the apparatus can be adjusted by regulating its rotation speed. To this end, means for regulating the rotation speed can be provided and examples thereof will be given hereinafter.

An apparatus according to the invention can operate at slow speeds. For a fixed flow, a slow speed will lead to the use of more voluminous chambers and therefore less appropriate for miniaturization for treating low flow rates.

A determinative advantage of the invention results from its capacity of accepting, without any counter-indication, the formation by expansion of two-phase fluid, whose liquid phase can optionally be evacuated to the exhaust or escape without causing any problem.

Variants of the apparatus of FIG. 4A are given in FIGS. 4B and 4C. In FIG. 4B, a helical cold source 35 is fixed to the flat bottom 34 of the fixed spiral. In FIG. 4C a cold source 37 is integrated into the walls of the fixed spiral, so that a fluid can circulate in said walls.

FIG. 5 shows a cryogenic expansion engine, whose fixed parts are supported by a structure 50 carrying two eccentric shafts 52, 63.

The shaft 52 centred on the bearing 53 incorporates an electric brake constituted by a rotor 54 and a stator 55 making it possible to control the rotation speed and extract the expansion work to an adaptable charge receiver 56.

The shaft 52 is provided with two offset or eccentric spindles 57 and 58 making it possible, by means of bearings 59 and 60 and an arm 62, to bring about a mechanical connection with a mobile plate 61. The arm 62 permits a very stable and precise positioning. The mass of said arm can be chosen so as to bring the centre of gravity of the mobile assembly to the desired level.

The mobile plate 61 is linked by the second offset shaft 63 mounted on ball bearings 64 and 65. The movement of said shaft 63 is in phase with that of the shaft 52, so that the movement of the plate 61 is a rotation-free, circular translation.

All the mechanical parts described hereinbefore operate at ordinary temperature in a case 66 and a platen 67, which contain the cycle fluid 68. The latter can e.g. be helium at the exhaust pressure of the expansion engine, which is close to atmospheric pressure.

The compressed gas 69 exerts an energy or work by placing in movement the mobile spiral 70 and the plate 61, both being fixed to at least one connecting or linking element 71. The plate and fixed spiral 72 carried by a tube 73 are protected from external heat supplies by an enclosure 74, which also makes it possible to place under vacuum the volume 75 using conventional, not shown means.

The connecting element 71 and tube 73 have a hot end and a cold end. They are preferably dimensioned so as to be mechanically rigid, whilst bringing about a minimum heat leak to the circuit of gas to be expanded.

An auxiliary cooling circuit 76, e.g. supplied with liquid nitrogen at 80 K., makes it possible to reduce heat leaks to the plates 70 and 72.

In a Claude cycle helium liquefier, as illustrated in FIG. 2B, expansion engines of the type according to FIG. 5 can be used with gas 69 and plates 70 and 72 operating, in the first stage, at 50 to 60 kelvin or, in the second stage, at 15 to 20 kelvin.

The final expansion stage, where partial liquefaction takes place, operates at 5 to 7 kelvin and in this case the auxiliary circuit 76 is preferably supplied by the preceding stages at 50 or 20 K.

Under the effect of the expansion of the gas 69 in the compartment containing the spiral 70, 72, the mobile spiral is put into movement. The latter is transmitted, by the connecting element 71, to the plate 61. The in phase, eccentric shafts 52, 63 make it possible to block the self-rotation component of the movement of the mobile spiral. What is left is the rotary translation movement of the latter, i.e. of the plate 61 and the arm 62. As a result of the offset spindles 57, 58, the shaft 52 is rotated. The electric brake (stator 55 and rotor 54) makes it possible to control the speed of said rotation and therefore the rotation of the spindles 57, 58 and consequently the speed of the rotary translation movement of the mobile spiral 70.

Other solutions can be found for preventing the rotation of the mobile spiral. It is e.g. possible to use deformable elements such as a network of fibres or springs, one end of each fibre or spring being fixed to the mobile spiral or to its flat bottom, whilst the other end is connected to the fixed part of the apparatus.

A solution using a deformable element is illustrated in FIG. 6. The mobile spiral 77 is connected by connecting elements 78 to a mobile plate 79, whose self-rotation is blocked by a bellows 83. The lower part of the latter is fixed to the plate 79 and its upper part is fixed to a fixed part 84 of the apparatus. The bellows also makes it possible to separate the atmosphere of the part 86 of the enclosure, where lubricant vapours can exist, from the part 87 of the enclosure reserved for the high purity, cycle gas. A shaft 80 with a cam 85 fixes the circular translation travel of the plate 79. This shaft 80 rotates about its spindle 88, fixed with respect to the apparatus. The spindle 85 rotates about the fixed spindle 88. The shaft 80 can also support the rotor 81 of an electric brake, whose stator is 82. The apparatus is otherwise identical or similar to that described hereinbefore in conjunction with FIG. 5.

Another solution uses magnetic means exerting forces in such a way that the translation can take place, whilst preventing rotation.

The principle of this solution is illustrated in FIG. 7. The mobile part 88 or rather the flat bottom or top of the mobile spiral is integral with a bar 89, which is either ferromagnetic, or under permanent magnetization. Both are placed in the magnetic field of an external dipole 90, whose parallel field lines fix the orientation of the part.

The mobile part 88 and its bar 89 are shown in three different positions. These parts can be connected to a plate such as the plate 79 of FIG. 6, the latter being itself guided by a single cam, as described hereinbefore in conjunction with FIG. 6.

Another variant able to ensure the mechanical transmission of the circular translation movement will preferably be used as a result of its greater compactness and its greater dynamic balancing facility. This variant is illustrated in FIG. 8.

The fixed base 91 supports the stator of the electric brake 92 and the hot end of a bellows 93. The latter is intended for locking in rotation the mobile spiral 94. The mobile part is constituted by the central plate 95 connected to the mobile spiral 94 by connecting elements 96.

An eccentric bush 97, which is free in rotation, is centred in the base 91 by the bearing 99 and supports the central plate 95 by means of the bearing 98. The circular translation of the mobile spiral 94 is transformed into a rotation of the bush 97, whose speed is controlled by the electric brake 92.

A dynamic balancing is obtained on the one hand by a shim 100 making it possible to bring into the plane of the bearings 98, 99 the centre of gravity of the mobile assembly 94, 96, 95, 100 and on the other hand by shims 101, 102 making it possible to balance all the inertias applied horizontally within the bearing 99.

All the solutions described hereinbefore use different mechanical variants, but are essentially designed to operate at ordinary temperature.

The use of contactless cryogenic bearings (e.g. magnetic bearings or gas bearings) can also give rise to a second family of solutions. This latter solution has the advantage of a greater mechanical rigidity in order to make it possible to ensure a better control of the respective position of the fixed and mobile spirals used in implementation of the invention.

An example, illustrated in FIG. 9, uses in combination radial gas bearings and a magnetic, axial abutment. The reverse would also be usable, as is any other conceivable combination between these two known technologies.

The example of FIG. 9 shows a helium expansion engine at 7 K. and approximately 15 bars which, by expansion, passes out of the spiral at 4.5 K. under 1 bar in double phase, with a high liquid proportion.

The same solution could a fortiori be used for helium expansion at any other temperature, such as e.g. 20 or 60 K., or any other pressure.

In the same way, the same solution could be used for the expansion of any other gas, such as e.g. hydrogen, neon or nitrogen, at adapted temperature and pressure levels.

The gas to be expanded enters by the pipe 111 at 7 K., supplies its work between the fixed spiral 112 and mobile spiral 113, before passing out in the form of a liquid-vapour mixture through pipe 134.

The mobile equipment, actuated by the spiral 113, is connected by connecting elements 115 to the plate 116, which rotates the eccentric bush 117, maintained in an axial position by the connection 118 to ball bearing 119 located in the hot part, at 300 K., and which is braked and speed controlled by the electric brake 120.

The plate 116 is locked in rotation by the bellows 121, itself fixed to the hot casing 122. The rotation of the bush 117 makes it possible to maintain, on its two faces, two hydrodynamic, gas bearings 123, 124, which ensure the contactless movement within the cryostat 125. The latter is protected from parasitic heat entry by auxiliary cooling circuits 126, which maintain the plate 116 of the bush 117 and the bearings 123, 124, as well as a heat shield 127, at 20 K. and by the circuit 128 supplied at 80 K. with liquid nitrogen and which is connected to the shield 129.

All the cold parts are installed in a vacuum enclosure 130, whose pumping means are not shown.

The axial clearance between the two spirals 112, 113 is preferably stringently controlled in order to remain close to a few hundredths of a millimeter. This clearance, measured by a cold position sensor 131, is controlled by a regulator 132 acting on the electromagnet 133 by controlled attraction of a ferromagnetic plate 134.

To avoid having to generate excessive forces in the electromagnet 133, it is either possible to perforate the wall of the bellows 121 to place it in equipressure, or control the internal pressure of the values 121 so as to give a value close to the expansion pressure of the mixture obtained in the discharge pipe 134.

An expansion engine according to one of the embodiments described hereinbefore can be used for implementing a Brayton cycle, as described in the introduction to the present specification in conjunction with FIG. 2A.

The invention is not limited to the construction of single-stage expansion engines using only a single pair of spirals, one being fixed and the other mobile.

In particular, it can be implemented in such a way that the same mechanical equipment and the same suspension clearance can be used for the operation of several expansion engines. For example, for obtaining a Claude cycle refrigerator as illustrated in FIG. 2B, the same mechanical equipment can be used for bringing about the operation of a three-stage expansion engine shown in FIG. 10, where deliberately several previously described variants have been combined.

In the first stage, the helium enters under 15 bars and 80 K. through the pipe 141 and is discharged expanded at 1.1 bar at 50 K. at 142.

The second stage operates between 15 bars, 25 K. (at point 143) and 1.2 bar, 15 K. (at point 144). The third stage receives at 145 gas under 15 bars and 7 K., which leaves in 146 at 4.4 K. in the form of a liquid-gas mixture under 1.3 bar.

A possible variant for making the expansion on the third stage more isothermal could involve covering the plate of the fixed spiral 171 with a condenser 180, where direct condensation could take place of the liquid helium supplying the cold source.

The three mobile spirals 147, 148, 149 are connected to the same shaft 150, whose sections decrease with the temperature level. The shaft 150 is integral with a plate 151 at ambient temperature and a plate 152 at a temperature of approximately 30 Kelvin.

The plate 151 actuates in rotation the eccentric collar 153 mounted on ball bearings 154 and 155, said collar being speed controlled by the brake 156.

A different technology is used for the cold plate 152 involving the rotation of an eccentric collar 157. It could also be braked but, in FIG. 10, it is shown free.

The eccentric ring 157 is maintained in position by a vertical, magnetic abutment 158. It is radially centred by two hydrodynamic, gas bearings 159, 160, which could be replaced by magnetic bearings, either with permanent magnets, or superconductors, the type being defined as a function of the temperature level.

The fixed spirals 171, 172, 173 are integral with a casing 174 insulated by a vacuum enclosure (whereof only the start 175 has been sketched, without showing its pumping means).

The gas circuits are separated from one another by bellows 176, 177.

Another bellows 178 separates the cryogenic circuit from the casing 179 which can either function at a different pressure, or can contain lubricant vapours if the bearings 154, 155 are greased.

The bellows 176, 177, 178 also contribute to the fixing in rotation of the mobile equipment integral with the plates 151, 152 and the shaft 150 in order to control the desired, circular translation movement.

The example has been given of a three-stage expansion engine for producing a Claude cycle. It is possible to produce an expansion engine with a different number of stages (i.e. two, or a number N>3). It is also possible to use any combination of the embodiments described hereinbefore.

In all the examples described hereinbefore, the respective position of the fixed and mobile spirals must preferably be precisely adjustable, in order to limit clearances in both the axial and radial directions. The regulating means used are of a conventional nature and are not shown in order not to overburden the illustrations. It is e.g. possible to use shims appropriate for the axial settings and to provide centre-to-centre regulating means for the eccentric shafts in order to adjust the strokes and travels. It is also possible to envisage position grinding operations in order to eliminate possible geometrical or surface defects.

I claim:

1. In an apparatus for lowering the temperature of a cryogenic fluid in an engine by fluid expansion in the gaseous or liquid state or in double phase wherein the engine has an expansion compartment with an admitting tube for admitting the fluid to be expanded and an exhaust, the improvement comprising:

a first spiral (28, 72, 112, 171, 172, 173), a second spiral (30, 70, 77, 94, 113, 147, 148, 149) placed within said first spiral, and means (52, 63; 80, 83, 85; 93, 95 97; 116, 117, 121) to permit a circular translation movement without self-rotation of the second spiral within the first spiral, during the expansion of said fluid.

2. In an apparatus as defined in claim 1, with means permitting a circular translation movement without self-rotation comprising two eccentric shafts, each being connected to a mobile spiral by an end rotating about a spindle fixed with respect to the apparatus.

3. In an apparatus as defined in claim 2, one of the cams carrying the rotor of an electric brake, the stator being fixed with respect to the apparatus.

4. In an apparatus as defined in claim 1, with means permitting a circular translation movement without self-rotation comprising at least one deformable part connected by one of its ends to a fixed part of the apparatus and whose other end is connected to a mobile spiral.

5. In an apparatus as defined in claim 4, the deformable part or parts comprising a bellows, and a network of fibres or springs.

6. In an apparatus as defined in claim 4, also comprising an eccentric shaft connected to the mobile spiral by an end rotating about a spindle fixed with respect to the apparatus.

7. In an apparatus as defined in claim 6, the eccentric shaft supporting the rotor of an electric brake, whose stator is fixed with respect to the apparatus.

8. In an apparatus as defined in claim 4, the mobile spiral being connected to a part about which an eccentric bush rotates.

9. In an apparatus as defined in claim 8, a part connected to the eccentric bush supporting the rotor of an electric brake, whose stator is fixed with respect to the apparatus.

10. In an apparatus as defined as in claim 9, the rotation of the bush taking place in a cryostat.

11. In an apparatus as defined as in claim 8, the rotation of the bush taking place on at least one of its two faces by a contactless bearing.

12. In an apparatus as defined as in claim 11, the bearing being of the magnetic type.

13. In an apparatus as defined as in 11, the bearing being of the gas type.

14. In an apparatus as defined as in claim 11, also comprising a means for controlling the axial clearance between the two spirals.

15. In an apparatus as defined in claim 1, with means permitting a circular translation movement without self-rotation being magnetic means exerting on the mobile spiral or on a fixed part with respect to the mobile spiral, forces such that the translation can take place so as to prevent any rotation.

16. In an apparatus as defined in claim 15, the mobile part being integral with at least one ferromagnetic or permanent magnetization element, means being provided to generate a magnetization, whose field lines fix the orientation of the mobile part.

17. In an apparatus as defined in claim 1, also comprising means for controlling the rotation speed of the mobile spiral during its movement.

18. In an apparatus as defined as in claim 1, the spirals being Archimedean spirals.

19. In an apparatus as defined as in claim 1, the spirals being defined by a succession of circular arcs.

20. In an apparatus as defined in claim 1, the partitions of the spirals being at variable heights.

21. In an apparatus as defined in claim 1, each spiral being connected to a flat bottom.

22. In an apparatus as defined in claim 1, a reduced clearance being ensured, at least at the operating temperature of the apparatus, between the upper part of the partition of one spiral and the flat bottom of the other spiral.

23. In an apparatus as defined in claim 1, the materials from which the two spirals are made having a low thermal expansion coefficient.

24. In an apparatus as defined in claim 23, the spirals having a composite carbon fibre or metal alloy material.

25. In an apparatus as defined in claim 1, plastics materials being used, at least locally, at least in the part of one of the two spirals facing the bottom of the other spiral.

26. In an apparatus as defined in claim 1 using in at least one of the spirals a heat exchange circuit in conjunction with the cold source in order to make the expansion more isothermal.

27. Fluid expansion system for lowering the temperature of a cryogenic fluid in an engine by fluid expansion incorporating at least two expansion stages with each stage comprising a first spiral (28, 72, 112, 171, 172, 173), a second spiral (30, 70, 77, 94, 113, 147, 148, 149) placed within said first spiral, and means (52, 63; 80, 83, 85; 93, 95, 97; 116, 117, 121) to permit a circular translation movement without self-rotation of the second spiral within the first spiral, during the expansion of the fluid.

28. Fluid expansion system as defined in claim 27 further comprising a common shaft being interconnected between the mobile spirals of each expansion stage for permitting an in phase movement of the mobile spirals.

29. Cryogenic expansion engine comprising a compressor, a heat exchanger and an expansion apparatus for lowering the temperature of a cryogenic fluid in an expansion compartment of the engine by fluid expansion, with the expansion compartment having an admitting tube for admitting the fluid to be expanded and an exhaust, said expansion apparatus comprising:

a first spiral(28, 72, 112, 171, 172, 173), a second spiral (30, 70, 77, 94, 113, 147, 148, 149) placed within said first spiral, and means (52, 63; 80, 83, 85; 93, 95, 97; 116, 117, 121) to permit a circular translation movement without self-rotation of the second spiral within the first spiral, during the expansion of the fluid.

30. Cryogenic expansion engine as in claim 29 incorporating two expansion stages.

* * * * *